US005430534A

United States Patent [19]

Shirasaka et al.

[11] Patent Number: 5,430,534

[45] Date of Patent: Jul. 4, 1995

[54] COPY ITEM TRANSPORT DEVICE FOR USE IN AN IMAGE FORMING APPARATUS

[75] Inventors: Kazumi Shirasaka; Akinobu Nakahata; Masahiro Shinohara; Kenji Oda; Takashi Mihara; Wataru Sasaki, all of Osaka, Japan

[73] Assignee: Mita Industrial Co., Ltd., Osaka, Japan

[21] Appl. No.: 130,474

[22] Filed: Oct. 1, 1993

[30] Foreign Application Priority Data

Oct. 6, 1992 [JP] Japan ..... 4-267379
Oct. 7, 1992 [JP] Japan ..... 4-268767

[51] Int. Cl.[6] ..... G03G 21/00; B65H 3/46; B65H 3/52

[52] U.S. Cl. ..... 355/309; 271/122

[58] Field of Search ..... 271/121, 122, 125; 355/309

[56] References Cited

U.S. PATENT DOCUMENTS 3,949,979 4/1976 Taylor et al. ..... 271/121 X
5,016,866 5/1991 Takahashi ..... 271/122
5,172,899 12/1992 Tajima ..... 271/122
5,172,900 12/1992 Uno et al. ..... 271/125
5,232,211 8/1993 Kubota et al. ..... 271/122 X
5,292,115 3/1994 Egi et al. ..... 271/122

*Primary Examiner*—Fred L. Braun
*Attorney, Agent, or Firm*—Jordan and Hamburg

[57] ABSTRACT

A copy item transport device is used in an image forming apparatus having an image bearing member and a pair of registration rollers before the image bearing member, and includes a separator for regulating multiple copy items to one copy item for each image formation. The separator is constructed by a forward roller being driven in a forward direction of transporting the copy item to the registration roller pair, a reverse roller in contact with the forward roller. The reverse roller is driven in a reverse direction of transporting the copy item backward, but rotatable in the forward direction together with the forward roller when receiving a greater transmitted forward torque from the forward roller than the reverse torque. The reverse drive to the reverse roller is stopped at the same time or after the forward drive to the forward roller is stopped to assure the nip of copy item by the registration roller pair.

3 Claims, 8 Drawing Sheets

COPY ITEM TRANSPORT DEVICE FOR USE IN AN IMAGE FORMING APPARATUS

BACKGROUND OF THE INVENTION

The present invention relates to a copy item transport device provided in an image forming apparatus such as a copying machine, a printer and like apparatus, and more particularly to a structure of a separating device for separating copy items while being transported and to a control for transporting of copy items.

Conventional copy item transport devices for use in image forming apparatuses to transport copy items from a cassette to a photosensitive member have been known to be provided with a separating device including a pair of separating rollers. Such separating device is arranged in a specified position along a transport path between the cassette and a pair of registration rollers so that the device may prevent a so-called multiple feeding that a plurality of copy items are simultaneously fed from the cassette.

FIG. 7 is a side elevation view in section showing a construction of one of the conventional separating devices.

In this figure, the separating device 100 is provided downstream from a cassette so as to transport a copy item to a pair of registration rollers arranged downstream of a item transport direction while separating multiply fed copy items.

The separating device 100 includes a forward roller 103 and a pair of reverse rollers 104, 104'. The forward roller 103 is fixedly mounted on an intermediate portion of a drive shaft 105 whose front and rear ends are supported rotatably respectively by front and rear support plates 101, 102. The drive shaft 105 is driven in a direction of transporting the copy item to the downstream side by an unillustrated drive mechanism (shown in the arrow direction in FIG. 7 and hereinafter referred to as forward direction). The forward roller 103 is provided closer to the front support plate 101 than to the rear support plate 102 in consideration of the arrangement of a transport path.

The reverse rollers 104, 104' are mounted on an intermediate portion of a drive shaft 106 rotatably respectively through friction clutches 107, 107'. The drive shaft 106 is supported rotatably at front and rear ends thereof respectively by the front and rear support plates 101, 102 and movable toward and away from the drive shaft 105. The friction clutches 107, 107' are provided in such a manner that a transmission of a drive torque of the drive shaft 106 to the reverse rollers 104, 104' is cut off to put the reverse rollers 104, 104' in an idly rotating state when the driven torque from the forward roller 103 is larger than a predetermined value (hereinafter referred to as torque limit value).

The reverse rollers 104, 104' are arranged equidistantly from a widthwise center O of the forward roller 103. Thus, a distance L1 between the front support plate 101 and a widthwise center A of the front reverse roller 104 is shorter than a distance L2 between the rear support plate 102 and a widthwise center B of the rear reverse roller 104'.

At respective support positions where the shaft 106 is supported by the front and rear support plates 101, 102 are provided helical springs 108, 108' to urge the drive shaft 106 toward the drive shaft 105. The springs 108, 108' are provided with the same spring constant to give substantially the same urging forces to the both end of the drive shaft 106. By the resilient forces of the springs 108, 108', respective circumferential surfaces of the reverse rollers 104, 104' are pressed against a circumferential surface of the forward roller 103 at a specified pressure. Further, the drive shaft 106 is driven in a direction opposite to the forward direction (hereinafter referred to as reverse direction) by an unillustrated drive mechanism.

The springs 108, 108' are provided with such a resilient force that the driven torque which is transmitted from the forward roller 103 to the reverse rollers 104, 104' by the frictional force between the forward roller 103 and the reverse rollers 104, 104' is a predetermined amount greater than the torque limit value of the friction clutches 107, 107'. Accordingly, in the state where the reverse rollers 104, 104' are in pressing contact with the forward roller 103, the reverse rollers 104, 104' are permitted to rotate in the forward direction together with the forward roller 103.

On the other hand, in the state where multiple copy items are nipped between the forward roller 103 and the reverse rollers 104, 104', the reverse rollers 104, 104' are rotated in the reverse direction by the drive shaft 106 owing to the fact that the multiple copy items cause the driven torque to be smaller than the torque limit value, and place the friction clutches 107, 107' in the engagement state.

Further, FIG. 8 shows an arrangement of a conventional copy item transport device including the above-mentioned separating device 100 and a pair of registration rollers. FIG. 9 is a timing chart showing a timing relationship between principal members of the conventional copy item transport device.

A registration sensor 111 for detecting the copy item transported to a pair 110 of registration rollers is arranged at an appropriate position on the downstream side of the separating device 100.

Upon printing start being instructed at time t1 in a stand-by state where the image forming apparatus is in an inoperative state, driving of the reverse rollers 104, 104' is started at time t2. Thereafter, driving of an unillustrated feed roller and the forward roller 103 is started at time t3 after lapse of a specified duration from time t2.

The forward roller 103 is maintained in an idly rotatable state during the duration from t2 to t3. A driven torque acting on the reverse rollers 104, 104' due to the frictional force between the forward roller 103 and the reverse rollers 104, 104' is smaller than the torque limit value of the friction clutches 107, 107'. Accordingly, the forward roller 103 is rotated in the reverse direction by the reverse rollers 104, 104'.

When the forward roller 103 is started driving in the forward direction, i.e., in the arrow direction in FIG. 7, at time t3, the driven torque acting on the reverse rollers 104, 104' becomes larger than the torque limit value. Consequently, the reverse rollers 104, 104' are rotated in the forward direction by the forward roller 103.

The copy item is fed out from the cassette by driving the feed roller and then nipped between the forward roller 103 and the reverse rollers 104, 104' and further transported downstream by the rotational force of the rollers 103. At this time, if multiple copy items are being fed, the driven torque acting on the reverse rollers 104, 104' becomes smaller than the torque limit value of the friction clutches 107, 107'. Consequently, the friction clutches 107, 107' come into the engagement state and the reverse roller 104, 104' are rotated in the reverse direction by the drive shaft 106. The copy item in contact with the forward roller 103 is transported to the downstream side by the forward driving of the forward roller 103. On the other hand, the other copy item in contact with the reverse rollers 104, 104' is kept at the nip position of the separating device 100.

The copy item being transported to the downstream side is detected by the registration sensor 111. Upon lapse of a specified duration after detection of the presence of copy item, the driving of the feed roller is stopped, and the registration roller pair 110 is started driving at time t4. The registration roller pair 110 is driven for a short duration T (t6−t4) to assuredly nip a leading end of the copy item.

On the other hand, the driving of the forward roller 103 is stopped at a time t5 in the duration T, during which the registration roller pair 110 is kept being rotated, to ensure the separation of copy item. On the other hand, the reverse rollers 104, 104' are continuously rotated for a longer duration beyond time t7 at which the driving of the registration roller pair 110 is started again to transport the copy item to a photosensitive member.

However, there have been the following problems in the prior art copy item transport device. In the separating device 100, the distance L1 between the front support plate 101 supporting the front end of the shaft 106 and the front reverse roller 104 is smaller than the distance L2 between the rear support plate 102 supporting the rear end of the shaft 106 and the rear reverse roller 104'. However, the springs 108, 108' have the same resilient. Accordingly, a pressing force of the front reverse roller 104 against the forward roller 103 differs from a pressing force of the rear reverse roller 104' against the forward roller 103. This is likely to cause the copy item to be transported obliquely due to the difference of pressing force between the front and rear reverse rollers 104, 104', involving undesirable formation of toner image on the copy item and deterioration of copy image.

To solve this problem, it can be considered to change the arrangement of the front support plate 101 or rear support plate 102 to make the distances L1 and L2 equal to each other. However, there has been a very difficulty in changing of the arrangement of the front or rear support plate 101, 102 because the change of arrangement of the front and rear support plates 101, 102 will unavoidably involve change of arrangement of the other members of the image forming apparatus, such as transport path means, various drive mechanisms.

Also, in the above-mentioned control of drive of the transporting members, the leading edge of the copy item is nipped between the registration roller pair 110 by driving the registration roller pair 110 for the short duration T (t6−t4). After the copy item being nipped, the registration roller pair 110 is stopped at time t6 and restarted at time t7 to transport the copy item to the photosensitive member.

On the other hand, the reverse rollers 104, 104' are kept being rotated in the reverse direction continuously after the nipping duration between times t6 and t7. Accordingly, there is a likelihood that the copy item having been nipped by the registration roller pair 110 is got out of the registration roller pair 110 by the reverse rotation of the reverse rollers 104, 104' and transported backward or upstream again.

More specifically, there are variations in the duration between the detection of leading edge of the copy item by the registration sensor 111 and the arrival of the leading edge at the registration roller pair 110 because of differences in the material and thickness of copy items. This causes the nipping state of copy item between the registration roller pair 110 to be varied. For example, if the leading edge of the copy item is not assuredly nipped by the registration roller pair 110, due to the fact that after time t6, the reverse rollers 104, 104' are kept being rotated in the reverse direction although the forward roller 103 has been stopped, the copy item is transported back by the reverse rotation of the reverse rollers 104, 104'. Accordingly, such backward transport of copy item makes impossible transporting of the copy item to the photosensitive member even when the registration roller pair 110 is restarted at time t7, or disrupts the transport timings to involve a deviation in transfer of toner image onto the copy item.

SUMMARY OF THE INVENTION

In view of the problems residing in the prior art, it is an object of the present invention to provide a copy item transport device which is capable of preventing oblique transport and backward transport of the copy item to ensure proper image formation on the copy item.

According to the present invention, a copy item transport device for use in an image forming apparatus having an image bearing member and a pair of registration rollers before the image bearing member, the copy item transport device comprises: separating means provided prior to the registration roller pair and adapted for regulating multiple copy items to one copy item for each image formation, the separating means including: forward roller means; first drive means for driving the forward roller means in a forward direction of transporting the copy item to the registration roller pair; reverse roller means associated with the forward roller means to transmit their respective rotational forces to each other; second drive means for rotating the reverse roller means in a reverse direction of transporting the copy item backward; and the reverse roller means being rotatable in the forward direction together with the forward roller means without being driven by the second drive means when the forward rotational force transmitted from the forward roller means to the reverse roller means is greater than the reverse rotational force of the second drive means; and controller means for suspending the second drive means at the same time or after the suspension of the first drive means.

With thus constructed copy item transport device, the second drive means for driving the reverse roller means is suspended at the same time or after the first drive means for driving the forward roller means is suspended. Accordingly, multiply fed copy items are properly separated, and the copy item is reliably nipped by the registration roller pair.

It may be preferable to suspend the second drive means before the pair of registration rollers are driven to transport the copy item to the image bearing member. Accordingly, the likelihood can be eliminated that the copy item having been transported at the registration roller pair is transported back by the reverse roller means.

Further, it may be appropriate that the forward roller means is constructed by a first shaft rotatably mounted between a first and second support members of the image forming apparatus, and a forward roller attached on the first shaft; and the reverse roller means is constructed by a second shaft rotatably mounted between the first and second support members, the second shaft being in parallel with the first shaft, and a reverse roller attached on the second shaft; and biasing means for biasing either the forward roller or the reverse roller to each other to come in contact with each other at a specified pressure, the biasing means being constructed by a first biasing member attached to the first support member, a second biasing member attached to the second support member, and the first and second biasing members being respectively provided with such biasing forces that the specified pressure is uniformly held on the entire contact surface of the forward and reverse rollers.

With this copy item transport device, the uniform contact pressure is applied to the entire contact surface of the forward and reverse rollers. This makes it possible to assuredly prevent oblique transport of copy items to ensure proper image formation.

Furthermore, it may be appropriate that the first biasing member is constructed by a first helical spring whose both ends are attached on the first support member and at whose center one end of either the first or second shaft is placed; and the second biasing member is constructed by a second helical spring whose both ends are attached on the second support member and at whose center the other end of either the first or second shaft is placed; and the first and second helical springs have the same spring constant and the same length under no load, the first expanded length between the center and the end of the first helical spring and the second expanded length between the center of the end of the second helical spring being respectively set at such distances that the specified pressure is uniformly held on the entire contact surface of the forward and reverse rollers. This construction will ensure simpler and easier adjustment of contact pressure.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
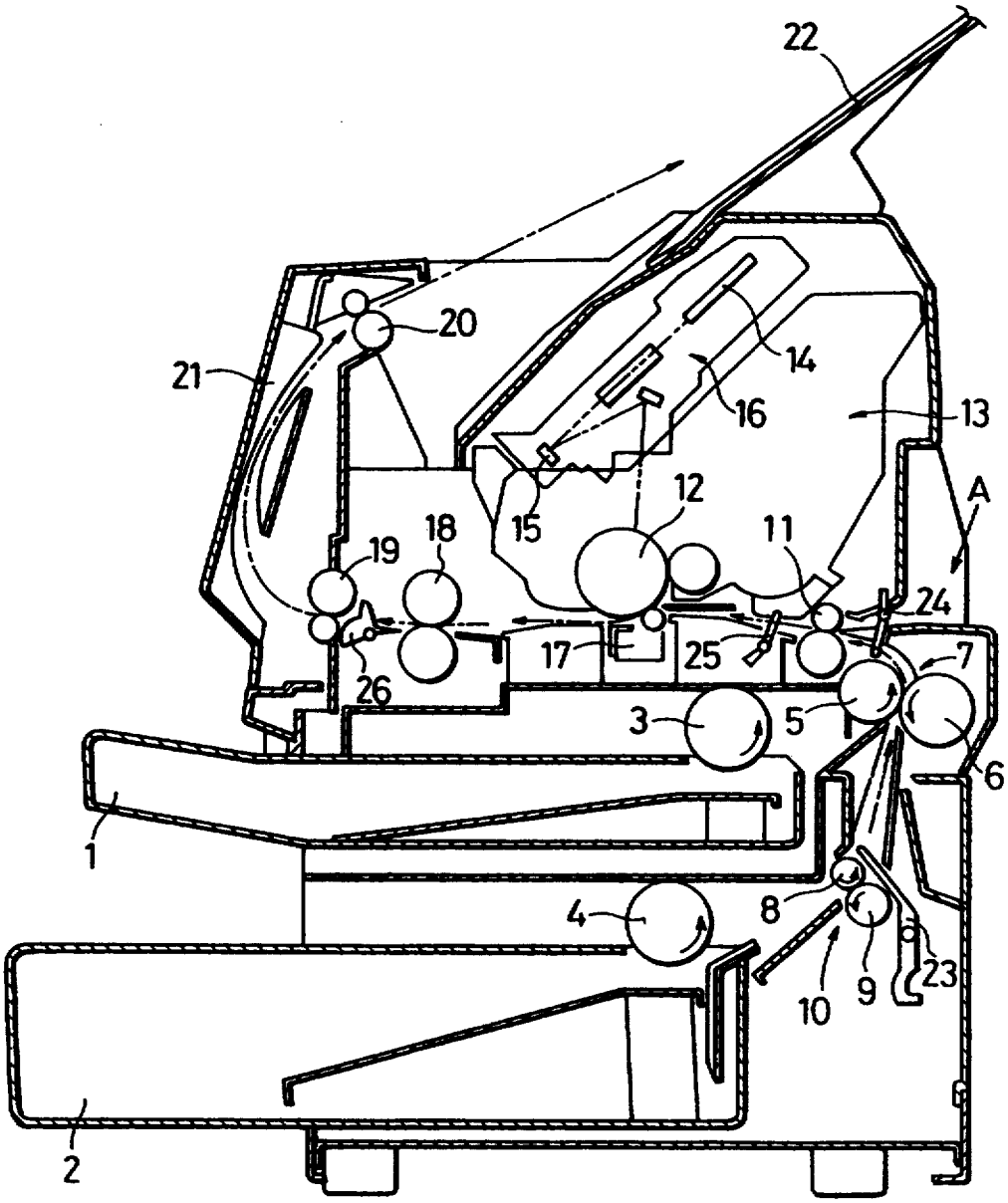
FIG. 1 is a schematic diagram in section showing an overall construction of an image forming apparatus incorporating a copy item transport device according to the invention.

FIG. 1 is a sectional diagram showing a schematic construction of an image forming apparatus incorporating a copy item transport device according to the invention. A cassette 1 for containing copy items such as normal copy sheets and a cassette 2 for containing copy items such as envelops side by side therein are mounted vertically and detachably on the image forming apparatus.

The cassette 2 includes two feeding portions disposed side by side in a widthwise direction thereof for feeding two envelopes placed side by side thereon. The cassette 2 may contain copy items of a different size other than the copy sheets contained in the cassette 1 so that the different sized copy items may be contained in the cassettes 1, 2. At each front end portion of the cassettes 1, 2 are arranged unillustrated identifying members including magnets or the like for identifying cassette types. With these identifying members, it is notified of an operator what type of the cassette is mounted on the apparatus.

Feed rollers 3, 4 are disposed at positions corresponding to the feeding portions of the cassettes 1, 2. A first separating device 7 including a single forward roller 5 and two reverse rollers 6, 6' (see FIG. 2) is provided in the vicinity of the mounting position of the cassette 1. A second separating device 10 including a single forward roller 8 and two reverse rollers 9 is provided in the vicinity of the mounting position of the cassette 2. The first and second separating devices 7, 10 transport copy items to registration rollers 11 while separating the copy items therebetween. Thus, feeding of multiple copy items to a photosensitive member 12 is prevented.

The copy sheet fed from the cassette 1 is transported to the registration rollers 11 while being separated by the first separating device 7. The envelops fed from the cassette 2 side by side are transported to the registration rollers 11 while being separated by the second separating device 10. In the case where the copy sheets or envelops are fed from the cassette 2, separation is not performed through the first separating device 7 since the separation is performed through the second separating device 10.

Downstream from the registration rollers 11, there are arranged an imaging unit 13 provided with the photosensitive member 12 and periphery devices including a transfer device 17, an unillustrated charger, a developing device, a cleaning device, etc arranged in the periphery of the photosensitive member 12. At a specified position above the imaging unit, there is arranged an optical unit 16 including a light emitter 14, a polygonal mirror 15, etc. A discharge tray 22 is arranged at a specified position above the optical unit 16. At a further downstream side of the imaging unit, there are arranged a fixing device 18, a pair of first discharge rollers 19. A discharge guide 21 and a pair of second discharge rollers 20 are provided at further downstream from the first discharge rollers 19 to transport the copy sheets or envelops to the discharge tray 22.

Various sensors are arranged at specified positions along a transport path for the copy items from the cassettes 1, 2 to the discharge tray 22. These sensors include a jam detection sensor 23 for detecting an occurrence of jam at the second separating device 10, a registration sensor 24 for measuring a timing at which the registration rollers 11 start rotating, an emission timing sensor 25 for measuring a timing at which the light emitter 14 emits a light, a discharge sensor 26 for detecting whether the copy item is being discharged, and the like. Each sensor has two sensing sections spaced apart in a widthwise direction so as to detect both items when the narrow items such as envelops are transported side by side.

Figure 2:
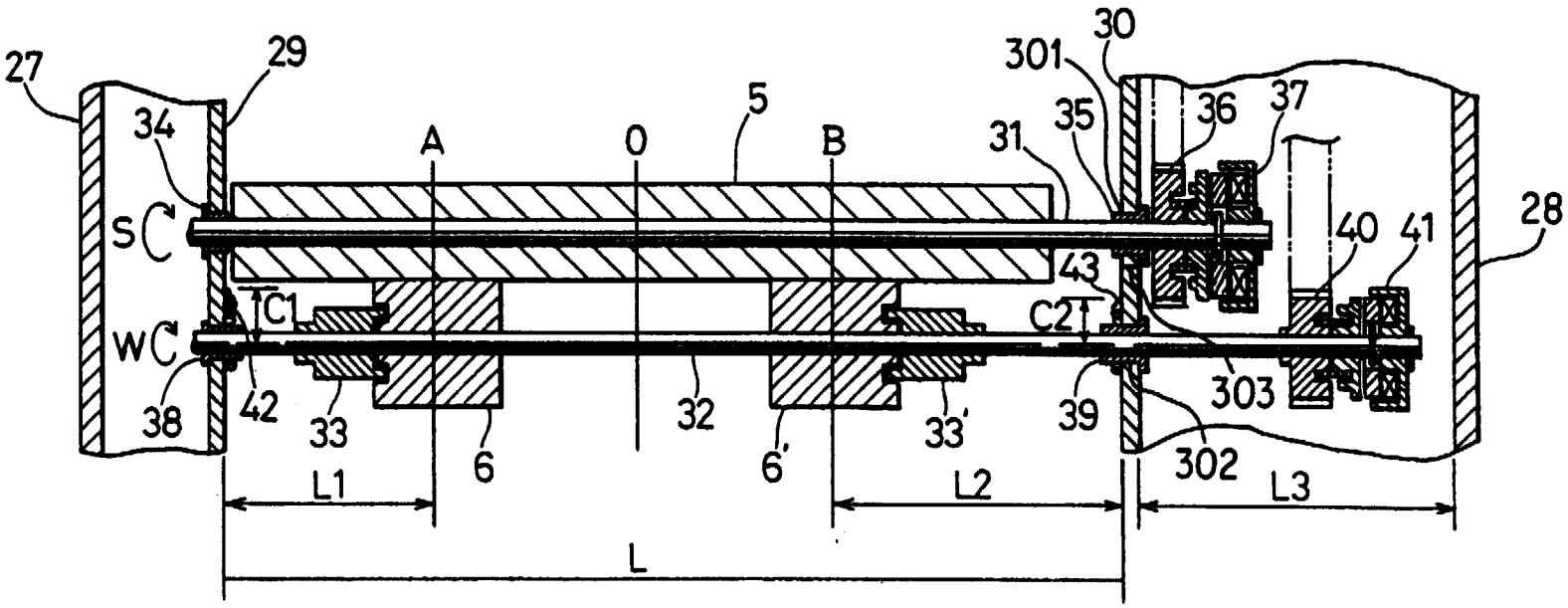
FIG. 2 is a side elevation view in section showing a construction of a separating device of the copy item transport device.
Figure 3:
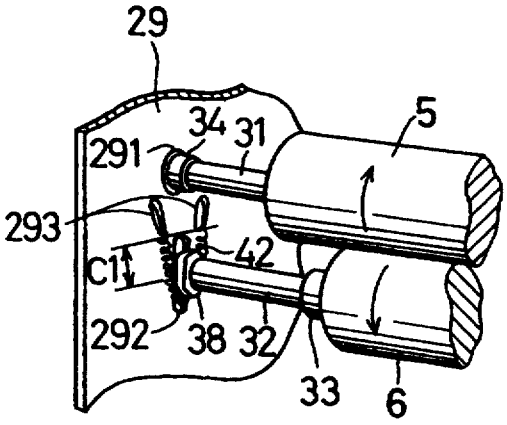
FIG. 3 is a perspective view showing supporting of respective front ends of a forward roller and a reverse roller of the separating device.

FIG. 2 is a side elevation view in section showing the construction of the first separating device 7. FIG. 3 is a perspective view essentially showing supporting of respective front ends of the forward roller 5 and the reverse rollers 6, 6'.

The cylindrical forward roller 5 has a length substantially equal to the maximum width of copy items to be transported. The forward roller 5 is fixed to a shaft 31 at front and rear support plates 29, 30 respectively provided at specified positions between a front side plate 27 and a rear side plate 28 of a main body of the image forming apparatus. The shaft 31 is rotatably supported by the front and rear support plates 29, 30. The forward roller 5 is disposed slightly closer to the front support plate 29 than the rear side plate 30 in consideration of the arrangement of the transport path.

The cylindrical reverse rollers 6, 6' each have a length substantially equal to the maximum width of envelops to be transported and are mounted rotatably to a shaft 32 through friction clutches 33, 33' provided on the shaft 32 for limiting a torque. The shaft 32 extends in parallel to the shaft 31 and is rotatably supported by the front and rear support plates 29, 30. The reverse rollers 6, 6' are disposed at suitable positions symmetrically side by side with respect to a widthwise center O of the forward roller 5.

The friction clutches 33, 33' cause the reverse rollers 6, 6' to rotate together with the shaft 32 when a load acting on the reverse rollers 6, 6' is smaller than a predetermined torque, while causing them to rotate idly relative to the shaft 32 when the load becomes in excess of the predetermined torque.

Referring to FIG. 3, at suitable positions of front and rear end portions of the shaft 31 are mounted rotatably bearings 34, 35, which are fitted respectively to round holes 291, 301 defined at specified positions of the front and rear support plates 29, 30 opposing to each other. Thus, the shaft 31 is supported rotatably by the front and rear support plates 29, 30. At suitable positions of front and rear end portions of the shaft 32 are mounted elliptically-shaped bearings 38, 39, which are fitted respectively to oblique holes 292, 302 defined at specified positions of the front and rear support plates 29, 30. The oblique holes 292, 302 are defined in the plates 29, 30 opposing to each other and spaced apart from the holes 291, 301 by a specified distance and extend vertically toward the holes 291, 301, respectively. Thus, the shaft 32 is rotatably supported by the front and rear support plates 29, 30.

The front and rear support plates 29, 30 are respectively defined with pairs of oblique holes 293, 303 at suitable positions between the round holes 291, 301 and the oblique holes 292, 302. A helical spring 42 wound around the bearing 38 in U-shape is engaged with the holes 293 at both end portions thereof. In the same way, a helical spring 43 wound around the bearing 39 in U-shape is engaged with the holes 303 at both end portions thereof. Accordingly, the shaft 32 is biased in a direction toward the shaft 31 by the compressive forces of the helical springs 42, 43, and thereby circumferential surfaces of the reverse rollers 6, 6' are pressed against a circumferential surface of the forward roller 5 at a specified pressure.

Since the forward roller 5 is arranged closer to the front support plate 29 than the rear support plate 30 as described above, a distance L1 between the front support plate 29 and a widthwise center position A of the reverse roller 6 is shorter than a distance L2 between the rear support plate 30 and a widthwise center position B of the reverse roller 6'. The difference between the distances L1 and L2 results in a difference between the pressing force F1 at which the reverse roller 6 is pressed against the forward roller 5 by the spring 42 and the pressing force F2 at which the reverse roller 6' is pressed against the forward roller 5 by the spring 43. Accordingly, in this embodiment, a distance C1 between an axis of the shaft 32 and a fixed end of the spring 42 in the oblique hole 293 (hereinafter referred to as a spring length C1) is caused to differ from a distance C2 between the axis of the shaft 32 and a fixed end of the spring 43 in the oblique hole 303 (hereinafter referred to as a spring length C2). In this way, the biasing force P1 of the spring 42 is made different from the biasing force P2 of the spring 43 so that the pressing force F1 becomes substantially equal to the pressing force F2. It should be noted that the springs 42 and 43 have the same length under no load.

Figure 4:
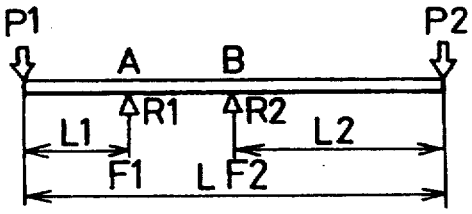
FIG. 4 is a diagram showing an acting state of forces of the forward and reverse rollers.

FIG. 4 is a diagram showing a balance of force acting between the reverse and forward rollers. In this figure, indicated at R1 is a force acting at the center position A of the reverse roller 6, and at R2 is a force acting at the center position B of the reverse roller 6'. Indicate at L is a distance between the front and rear support plates 29 and 30. If the pressing force F1 equals to the pressing force F2, force R1=force R2. Accordingly, an equation, P1+P2=R1+R2, can be obtained. On the other hand, the balance of rotation moment about the point B is expressed as follows.

$$P2\times L2-P1\times(L-L2)+R2\times(L-L1-L2)=0 \quad (1)$$

If R2=(P1+P2)/2 is substituted into the equation (1), the relationship between the biasing forces P1, P2 can be expressed as follows.

$$P1/P2=(L-(L1-L2))/(L+(L1-L2)) \quad (2)$$

Thus, the pressing forces F1, F2 of the reverse rollers 6, 6' are set substantially equal by adjusting suitably the spring lengths C1, C2 of the springs 42, 43 according to the spring constant thereof so as to satisfy the equation (2).

In this embodiment, there is described a case where the springs 42, 43 are mounted in an expanded state and the reverse rollers 6, 6' are brought into pressing contact with the forward roller 5 by making use of the compressive forces of the springs 42, 43. Even in an opposite case where the springs 42, 43 are mounted in a compressed state and the reverse rollers 6, 6' are brought into pressing contact with the forward roller 5 by making use of the expanding forces of the springs 42, 43, the pressing forces F1, F2 of the reverse rollers 6, 6' against the forward roller 5 can be set substantially equal by adjusting properly the spring lengths C1, C2.

Further, in the foregoing embodiment, the springs 42, 43 are set to have the substantially same length having the same spring constant, while the spring lengths C1, C2 are adjustable. However, the pressing forces F1, F2 of the reverse rollers 6, 6' against the forward roller 5 can be set substantially equal by making the spring lengths C1, C2 equal and adjusting properly the spring constants of the springs 42, 43.

Further, in the foregoing embodiment, the springs 42, 43 are used as biasing members of the shaft 32. However, according to the invention, the biasing members may be plate springs or may be members making use of air or hydraulic pressure.

Although the foregoing embodiment is described with respect to a separating device (a pair of separating rollers), the invention is also applicable to pairs of normal feed rollers and normal registration rollers.

Referring back to FIG. 2, a forward roller clutch 37 (switch means) such as an electromagnetic spring clutch is fixedly mounted to a rear end portion of the shaft 31 (at a right end portion of the shaft 31 in the figure). A drive gear 36 for transmitting a rotational force of an unillustrated drive motor is rotatably mounted to an inner side of the clutch 37. The forward roller clutch 37 transmits and cuts off the rotational force of the drive motor transmitted to the drive gear 36 to the shaft 31. While the clutch 37 is engaged with the drive gear 36 in an ON state, the clutch 37 is disengaged with the drive gear 36 in an OFF state. Accordingly, in the case where the clutch 37 is engaged with the drive gear 36, the rotational force of the drive motor transmitted to the drive gear 36 is transmitted to the shaft 31 by way of the clutch 37, thereby drivingly rotating the forward roller 5 in a direction of transporting the copy item downstream (shown by the arrow S in FIG. 2, hereinafter referred to as forward direction). In the case where the clutch 37 is disengaged with the drive gear 36, the transmission of the rotational force of the drive motor to the shaft 31 is cut off to thereby cause the forward roller 5 in an idly rotating state.

A reverse roller clutch 41 such as an electromagnetic spring clutch is fixedly mounted to a rear end portion of the shaft 32 (at a right end portion of the shaft 32 in the figure). A drive gear 40 for transmitting the rotational force of the drive motor is rotatably mounted to an inner side of the clutch 41. The reverse roller clutch 41 transmits and cuts off the rotational force of the drive motor transmitted to the drive gear 40 to the shaft 32. In an ON state of the clutch 41, the clutch 41 is engaged with the drive gear 40, while in an OFF state, the clutch 41 is disengaged with the drive gear 40. Accordingly, in the case where the clutch 41 is engaged with the drive gear 40, the rotational force of the drive motor transmitted to the drive gear 40 is transmitted to the shaft 32 by way of the clutch 41, thereby drivingly rotating the reverse rollers 6, 6' in a direction for transporting the copy item upstream (shown by the arrow W in FIG. 2, hereinafter referred to as reverse direction). In the case where the clutch 41 is disengaged with the drive gear 40, the transmission of the rotational force of the drive motor to the shaft 32 is cut off to thereby cause the reverse roller 6, 6' in an idly rotating state.

Although the electromagnetic spring clutch is used as the forward and reverse roller clutches 37, 41 in the foregoing embodiment, any device such as a clutch mechanism may be used provided that it is capable of transmitting and cutting off the driving force.

Figure 5:
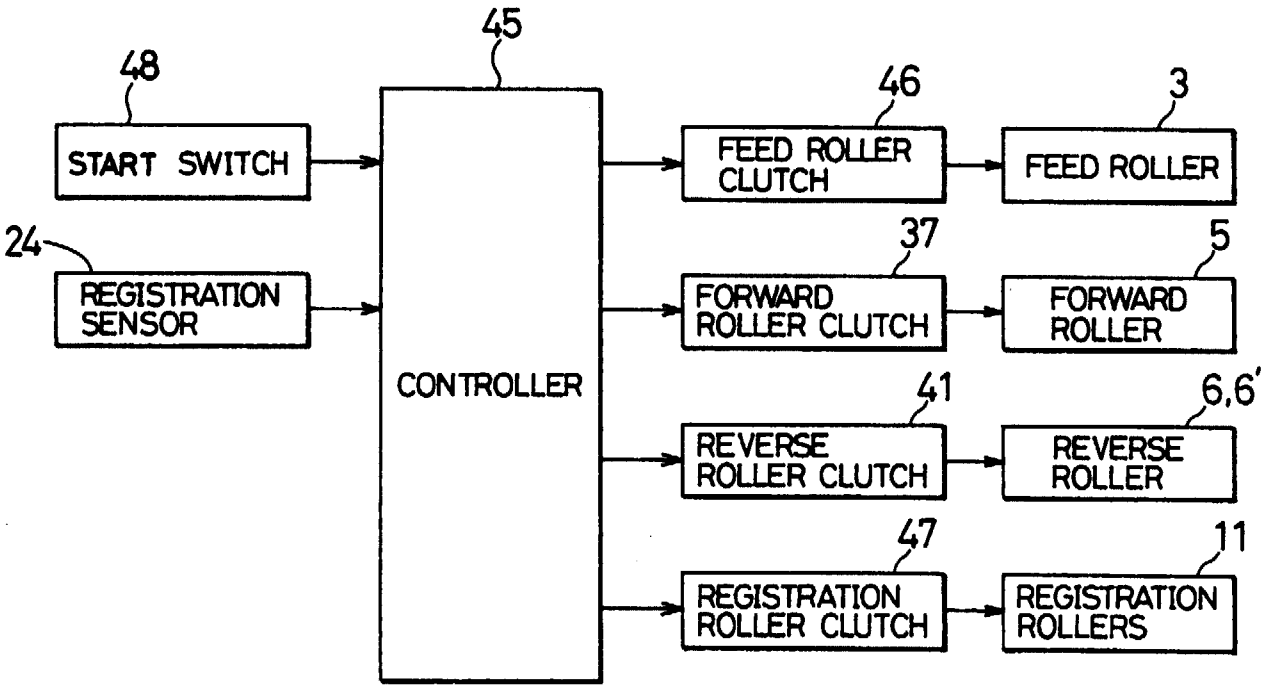
FIG. 5 is a block diagram showing a copy item transport control of the image forming apparatus.

FIG. 5 is a block diagram showing a copy item transport control of the image forming apparatus. This figure shows a control for driving of the feed rollers 3, 4, forward roller 5, reverse rollers 6, 6', and registration rollers 11. Specifically, the controller 45 controls respective engagement timings or on-off timings for a feed roller clutch 46, forward roller clutch 37, reverse roller clutch 41, and registration roller clutch 47 to thereby feed the copy item from the cassette 1, and separate the copy item through the first separating device 7, and transport the same to the registration rollers 11.

A start switch 48 is provided in an operation panel of the image forming apparatus main body and designates a timing at which a copying is started. Upon receiving a request signal from the start switch 48 for instructing the copy start, the controller 45 sends a signal for requesting item feed. It may also be appropriate to provide an arrangement in which such a start signal is sent to the controller 45 from another control unit for integrally controlling the whole copying operation instead of the start switch 48.

There will be described next an operation of the controller 45 with reference to FIG. 6.

Figure 6:
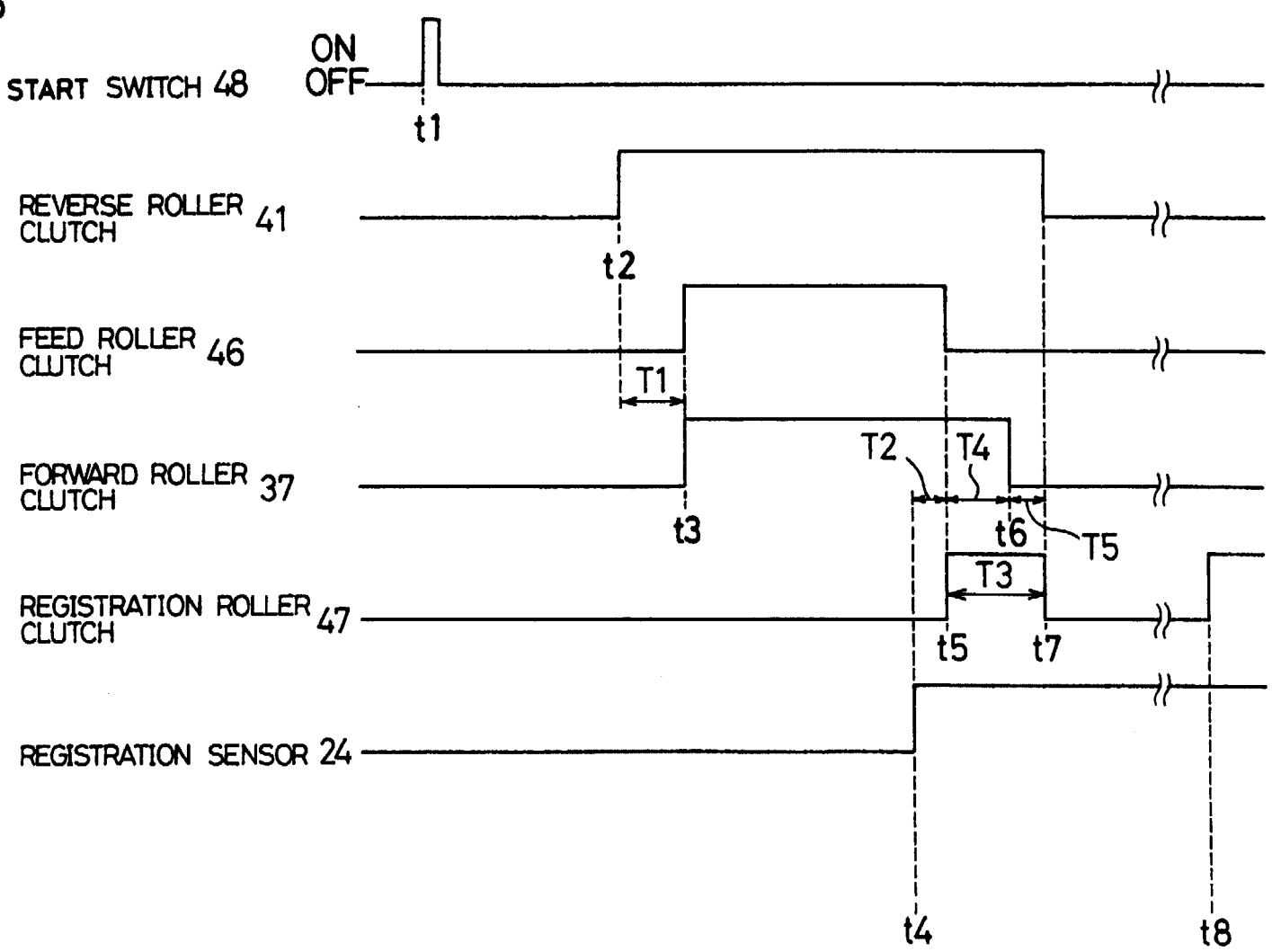
FIG. 6 is a chart showing a timing relationship between principal members of the image forming apparatus.
Figure 7:
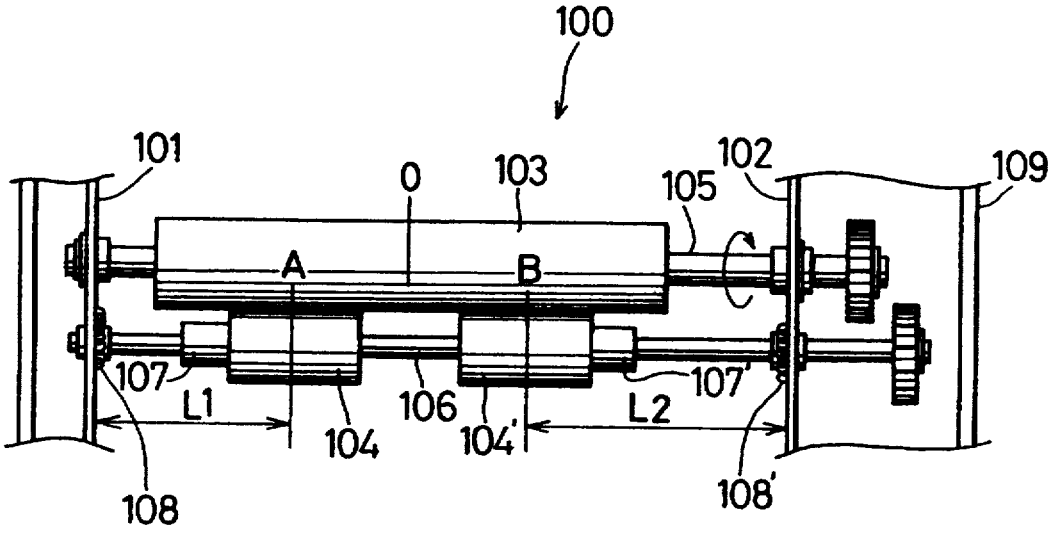
PRIOR ART FIG.7
FIG. 7 is a side elevation view in section showing a construction of a separating device of a copy item transport device of the prior art.
Figure 8:
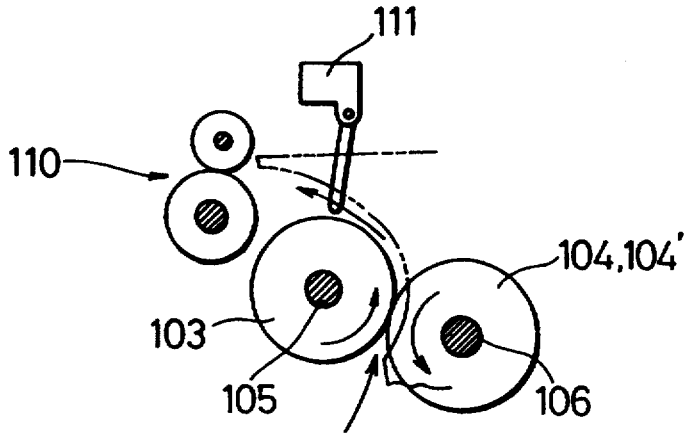
PRIOR ART FIG. 8
FIG. 8 is a sectional view showing an essential portion of the prior art copy item transport device.
Figure 9:
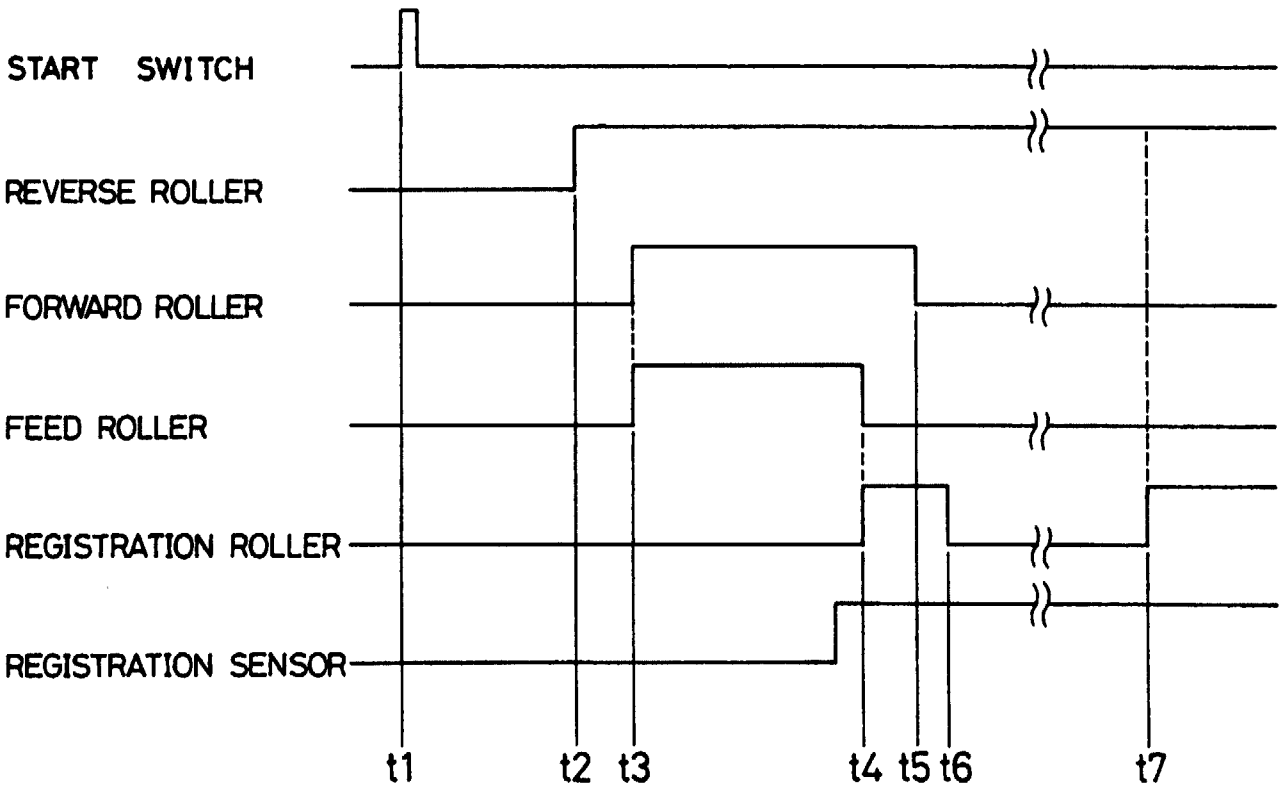
PRIOR ART FIG.9
FIG. 9 is a chart showing a timing relationship between principal members of the prior art copy item transport device.

FIG. 6 is a timing chart showing a timing relationship between the start switch 48, clutches 37, 41, 46, and 47, and registration sensor 24.

A specified time after the main switch being turned on, the image forming apparatus comes to copy enabled state. When the copy start signal is sent from the start switch 48 at time t1, the reverse roller clutch 41 is engaged at time t2. The feed roller clutch 46 and the forward roller clutch 37 are engaged at time t3 which a specified duration T1 elapses after time t2.

When the reverse roller clutch 41 is engaged, the rotational force transmitted to the drive gear 40 is transmitted to the shaft 32 to thereby drivingly rotate the reverse rollers 6, 6' in the reverse direction W. On the other hand, the forward roller clutch 37 is in an OFF state i.e., the forward roller 5 is in the idly rotating state at this time. Accordingly, the forward roller 5 rotates in the reverse direction together with the reverse rollers 6, 6'. This state continues until time t3 at which the forward roller clutch 37 is engaged.

When the feed roller clutch 46 is engaged at time t3, the rotational force is transmitted to a shaft carrying the feed roller 3 to rotate the feed roller 3 in the forward direction. The rotation of the feed roller 3 feeds out the copy item from the cassette 1 to the first separating device 7.

Also, when the forward roller clutch 37 is engaged at the same time when the feed roller clutch 46 is engaged at time t3, the rotational force transmitted to the drive gear 36 is transmitted to the shaft 31 to thereby rotate the forward roller 5 in the forward direction. The forward rotational force of the forward roller 5 is transmitted to the reverse rollers 6, 6' rotating in the reverse direction W. Thus transmitted forward rotational force is greater than the torque limit value of the friction clutches 33, 33'. Accordingly, the friction clutches 33, 33' come into disengagement. The rotational force of the drive gear 40 is cut off and the reverse rollers 6, 6' consequently start rotating in the forward direction together with the forward roller 5. This state continues until time t6 when the forward roller clutch 37 is disengaged.

The copy item fed to the first separating device 7 by the feed roller 3 is nipped between the forward roller 5 and the reverse rollers 6, 6', and is thereafter transported further downstream by the rotational force of the forward roller 5 and the reverse rollers 6, 6'.

However, if multiple copy items are being fed to the first separating device, the rotational force transmitted from the forward roller 5 to the reverse rollers 6, 6' becomes smaller than the torque limit value of the friction clutches 33, 33'. Consequently, the friction clutches 33, 33' come into engagement and the reverse rollers 6, 6' are rotated in the reverse direction W by the drive gear 40. The copy item in contact with the forward roller 5 is transported downstream by the forward rotational force of the forward roller 5 while the copy item in contact with the reverse rollers 6, 6' is kept at the nip position of the first separating device 7. The multiple copy items are properly separated, and only one copy item is then transported to the pair of registration rollers 11.

In this case, since the pressing forces P1, P2 of the reverse rollers 6, 6' are set substantially the same, there is not a noticeable difference between the respective transporting forces of the two reverse rollers 6, 6'. Accordingly, the copy item is transported downstream along the true transport path.

Upon a specified duration T2 elapsing after the leading edge of the copy item is detected by the registration sensor 24 at time t4, the feed roller clutch 46 is disengaged at time t5 to stop the feed roller 3. At the same time t5, the registration roller clutch 47 is engaged to rotate the registration roller pair 11. The registration rollers 11 are kept being rotated for a very short duration T3 to assuredly nip the leading edge of the copy item by the registration roller pair 11.

On the other hand, the first separating device 7 is kept being driven for a specified duration after the leading edge of the copy item reaches the registration roller pair 11. In the duration when the registration roller pair 11 is kept being rotated, the forward roller 5 is first stopped, and the reverse rollers 6, 6' are stopped at the same time when the registration roller pair 11 is stopped. Specifically, the forward roller clutch 37 is disengaged upon a lapse of a duration T4 (<T3) after time t5, namely, at time t6. The reverse roller clutch 41 is disengaged at the same time t7 when the registration roller clutch 47 is disengaged.

The stopping time of the reverse rollers 6, 6' is made to be later than the stopping time of the forward roller 5 to assure the prevention of the multiple feeding. It will be seen that this time difference will cause the copy item to be transported backward or upstream by a small amount by the reverse rollers 6, 6'. Specifically, the forward roller clutch 37 is disengaged and the reverse roller clutch 41 is kept being engaged during the specified duration T5 from time t6 to time t7. Consequently, similar to the operation during the duration T1 from t2 to t3, the forward roller 5 is rotated together with the reverse rollers 6, 6' for the duration T5, thereby causing the copy item having been transported to the registration roller pair 11 to be temporarily transported backward or upstream.

However, since the forward roller 5 was kept being rotated for the specified duration T4 after the registration roller pair 11 was started, the copy item transported to the registration roller pair 11 has been assuredly nipped by the registration roller pair 11 while being warped a little. Accordingly, even if the copy item is transported backward by the T5-reverse rotational force of the reverse rollers 6, 6', there will be no likelihood that the copy item gets out of the nip between the registration roller pair 11. To the contrary, the warp on the copy item will be removed.

When the reverse roller clutch 41 and the registration roller clutch 47 are disengaged at time t7, the copy item nipped between the registration roller pair 11 comes into a stand-by position, and is thereafter transported to the imaging unit 13 from the registration roller pair 11 at time t8 when a control signal is sent from an unillustrated control unit.

It should be noted that the time t6 at which the forward roller clutch 37 is disengaged is not required to be set within the duration T3 when the registration roller pair 11 is being driven, but may be set at an appropriate time in the duration from t7 to t8.

Further, it should be noted that the timing t7 at which the reverse roller clutch 41 is disengaged is not required to be set at the same time when the registration roller clutch 47 is disengaged, but may be set at an appropriate time in the duration from t7 to t8 on the condition of being no earlier than the disengaging time of the forward roller clutch 37 and before time t8. It may be preferable to determine the disengagement time of the reverse roller clutch 41 in consideration of the change in the transmitting force from forward roller 5 to the reverse rollers 6, 6' which is caused by variations in the material or thickness of copy item.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A copy item transport device for use in an image forming apparatus having an image bearing member and a pair of registration rollers before the image bearing member, the copy item transport device comprising:

separating means provided prior to the registration roller pair and adapted for regulating multiple copy items to one copy item for each image formulation, the separating means including:

forward roller means;

first drive means for driving the forward roller means in a forward direction of transporting the copy item to the registration roller pair;

reverse roller means associated with the forward roller means to transmit their respective rotational forces to each other;

second drive means for rotating the reverse roller means in a reverse direction of transporting the copy item backward; and the reverse roller means being rotatable in the forward direction together with the forward roller means without being driven by the second drive means when the forward rotational force transmitted from the forward roller means to the reverse roller means is greater than the reverse rotational force of the second drive means; and controller means for suspending the second drive means at the same time or after the suspension of the first drive means;

the controller means suspending the second drive means before the pair of registration rollers are driven to transport the copy item to the image bearing member.

2. A copy item transport device according to claim 1 wherein:

the image forming apparatus has a first support member and a second support member spaced from the first support member;

the forward roller means includes:

a first shaft rotatably mounted between the first and second support members; and a forward roller attached on the first shaft;

the reverse roller means includes:

a second shaft rotatably mounted between the first and second support members, the second shaft being in parallel with the first shaft; and a reverse roller attached on the second shaft;

biasing means for biasing either the forward roller or the reverse roller to each other to come in contact with each other at a specified pressure, the biasing means includes:

a first biasing member attached to the first support member;

a second biasing member attached to the second support member; and the first and second biasing members being respectively provided with such biasing forces that the specified pressure is uniformly held on the entire contact surface of the forward and reverse rollers.

3. A copy item transport device according to claim 2 wherein:

the first biasing member is a first helical spring whose both ends are attached on the first support member and at whose center one end of either the first or second shaft is placed;

the second biasing member is a second helical spring whose both ends are attached on the second support member and at whose center the other end of either the first or second shaft is placed;

the first and second helical springs have the same spring constant and the same length under no load, the first expanded length between the center and the end of the first helical spring and the second expanded length between the center of the end of the second helical spring being respectively set at such distances that the specified pressure is uniformly held on the entire contact surface of the forward and reverse rollers.

* * * * *